US008210631B2

(12) United States Patent
Bailey et al.

(10) Patent No.: US 8,210,631 B2
(45) Date of Patent: Jul. 3, 2012

(54) METHOD FOR MINIMIZING PRINTING DEFECTS DUE TO MISSING NOZZLE IN MEDIA PROCESSING DEVICE

(75) Inventors: James Ray Bailey, Georgetown, KY (US); Lucas David Barkley, Lexington, KY (US); John Booth Bates, Harrodsburg, KY (US); James Lesesne Bush, III, Lexington, KY (US); Michael Anthony Marra, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 535 days.

(21) Appl. No.: 12/410,625

(22) Filed: Mar. 25, 2009

(65) Prior Publication Data

US 2010/0245430 A1 Sep. 30, 2010

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

2002/0085057 A1* 7/2002 Endo ..... 347/19
2005/0046654 A1* 3/2005 King et al. ..... 347/16

* cited by examiner

*Primary Examiner* — Laura Martin

(57) ABSTRACT

Disclosed is a method for printing a media sheet in a media processing device. The method includes aligning a first portion of a printhead of the media processing device to a print area of the media sheet. The method further includes printing the print area of the media sheet by traversing the printhead over the print area in a first direction. The printing is performed by the first portion. Further, the method includes aligning a second portion of the printhead to the print area by adjusting the media sheet relative to the printhead by an index distance in a direction perpendicular to the first direction. Thereafter, the method includes reprinting the print area by traversing the printhead over the print area in a second direction opposite to the first direction. The reprinting is performed by the second portion.

14 Claims, 3 Drawing Sheets

METHOD FOR MINIMIZING PRINTING DEFECTS DUE TO MISSING NOZZLE IN MEDIA PROCESSING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The disclosure relates generally to media processing devices, and, more particularly, to method for minimizing printing defects due to missing nozzles in media processing devices.

2. Description of the Related Art

Media processing devices, such as inkjet printers, are commonly used to print a textual and/or a graphical data on a media sheet. A typical inkjet printer utilizes at least one printhead having a plurality of nozzles configured thereon. Each nozzle of the plurality of nozzles may be configured with an activation resistor and a bubble chamber adapted to receive ink therein. Each nozzle may be "fired" by means of activation resistors, such that a corresponding activation resistor of the nozzle heats the ink in the corresponding bubble chamber of the nozzle. The ink heats up to form an ink bubble in the bubble chamber. The ink bubble is expelled out of the nozzle on to a media sheet, thereby forming an ink dot on the media sheet. The printhead may be moved across (known as a "pass") the media sheet during which the plurality of nozzles may be selectively fired to print a textual and/or a graphical data on the media sheet.

Typical inkjet printers utilize various print modes based on design of the printhead and the media sheet being printed. Such print modes are typically designed to provide an optimal balance between print quality and print speed. For example, a default print mode, such as "Plain-paper, Normal Mode" emphasizes on good print quality at a fast speed on a plain media sheet. This often requires the number of printhead passes to be minimized while still being able to minimize the visibility of print defects caused by imperfections in the printhead and printing mechanism. One such defect, referred to as dry-time banding, is the result of printing bidirectional in multiple passes. In such a mode, the drying time for the ink on one side of a printed region is longer than the other side before another pass of the printhead places more ink on top of the region. This variable drying time results in a visible color difference on the ends of the printed regions. In particular when adjacent printed areas exhibit inconsistent dry-time, the associated visible defect is quite severe. Various conventional inkjet printers are known to incorporate solutions to the dry-timing banding defect.

One such conventional inkjet printer incorporates one pass bi-directional printing to avoid dry-time banding defects while printing. Because all ink is laid down in a single pass, dry-time banding is avoided. However, this type of print mode is susceptible to color-order defects, which are differences in color for swaths printed in one direction compared to the other direction. This color difference is caused by the printhead physically printing, for example, cyan then magenta then yellow to create a desired color in one direction. In the other direction, the printhead prints yellow then magenta then cyan to create a desired color. However, because the lay-down order of the colorants is different between directions, the mixture may result in different colors after it has dried and cause a color-order print defect that may present as a type of visible banding. This defect may be avoided by providing redundant ink channels (e.g. cyan->magenta->yellow->magenta->cyan) and printing with the required ink channels in each direction to achieve the same color order. This type of system requires additional cost due to the additional ink channels.

Another conventional inkjet printer incorporates two pass bi-directional printing with no paper movement between consecutive passes, followed by a movement of the printhead. Accordingly, same area on a media sheet is printed twice such that the area achieves a consistent color order. Moreover, the conventional inkjet printer achieves a consistency of time between passes that eliminates dry-time banding defects.

However, the conventional inkjet printers as described herein are not capable of avoiding printing defects occurring due to nonfunctional nozzles or blocked nozzles (hereinafter interchangeably referred to as "missing nozzles"). Specifically, some nozzles of the plurality of nozzles of a printhead may become blocked due to dried ink or due to deposition of some particulate matter therein. Moreover, the nozzles may be nonfunctional due to malfunctioning activation resistors thereof. Further, the number of missing nozzles may increase over a lifetime of the printhead.

While printing with a printhead having missing nozzles, desirable print quality may not be achieved due to missing ink drops corresponding to the missing nozzles. Such a printing defect may be observed in print quality of the conventional inkjet printers. Specifically, in the conventional inkjet printers a particular row of ink drops on the media sheets is printed by a distinct set of nozzles of the plurality of nozzles only. Accordingly, a media sheet printed by a printhead having missing nozzles may have missing ink drops even when a bi-directional printing is utilized for printing each row of ink drops on the media sheet. Additionally, upgrading inkjet printers towards permanent and semi-permanent printhead technology requires reducing printing defects due to missing nozzles to obtain acceptable print quality.

Based on the foregoing, there is a need to minimize printing defects while printing with a printhead having missing nozzles. Specifically, there exists a need for a method for printing a media sheet by a printhead such that the method minimizes printing defects on the media sheet due to missing nozzles in the printhead.

SUMMARY OF THE DISCLOSURE

In view of the foregoing disadvantages inherent in the prior art, the general purpose of the present disclosure is to provide a method for printing media sheets in a media processing device to include all the advantages of the prior art, and to overcome the drawbacks inherent therein. Specifically, the present disclosure describes a method for printing a media sheet in a media processing device such that the method is capable of minimizing printing defects due to missing nozzles in a printhead used for printing the media sheet.

Therefore, in one aspect, the present disclosure provides a method for printing a media sheet in a media processing device. The method includes aligning a first portion of a printhead of the media processing device to a print area of the media sheet. Further, the method includes printing the print area of the media sheet by traversing the printhead over the print area of the media sheet in a first direction. The printing of the print area of the media sheet is performed by the first portion of the printhead. Furthermore, the method includes aligning a second portion of the printhead to the print area of the media sheet by adjusting the media sheet relative to the printhead by an index distance in a direction perpendicular to the first direction. Moreover, the method includes reprinting the print area of the media sheet by traversing the printhead over the print area of the media sheet in a second direction opposite to the first direction. Specifically, the reprinting is performed by the second portion of the printhead.

Further in another aspect, the present disclosure provides a media processing device for printing a media sheet. The media processing device includes a printhead and a drive mechanism coupled to the printhead. The printhead is configured to print a print area of the media sheet. The drive mechanism is configured to align a first portion of the printhead to the print area of the media sheet. The printhead is configured to print the print area of the media sheet by traversing over the print area of the media sheet in a first direction and the printing of the print area is performed by the first portion of the printhead.

The drive mechanism is further configured to align a second portion of the printhead to the print area of the media sheet by adjusting the media sheet relative to the printhead by an index distance in a direction perpendicular to the first direction. Further, the printhead is configured to reprint the print area of the media sheet by traversing over the print area of the media sheet in a second direction opposite to the first direction and the reprinting of the print area is performed by the second portion of the printhead.

BRIEF DESCRIPTION OF THE DRAWINGS

The above-mentioned and other features and advantages of this present disclosure, and the manner of attaining them, will become more apparent and the present disclosure will be better understood by reference to the following description of embodiments of the disclosure taken in conjunction with the accompanying drawings, wherein.

DETAILED DESCRIPTION

Figure 1:
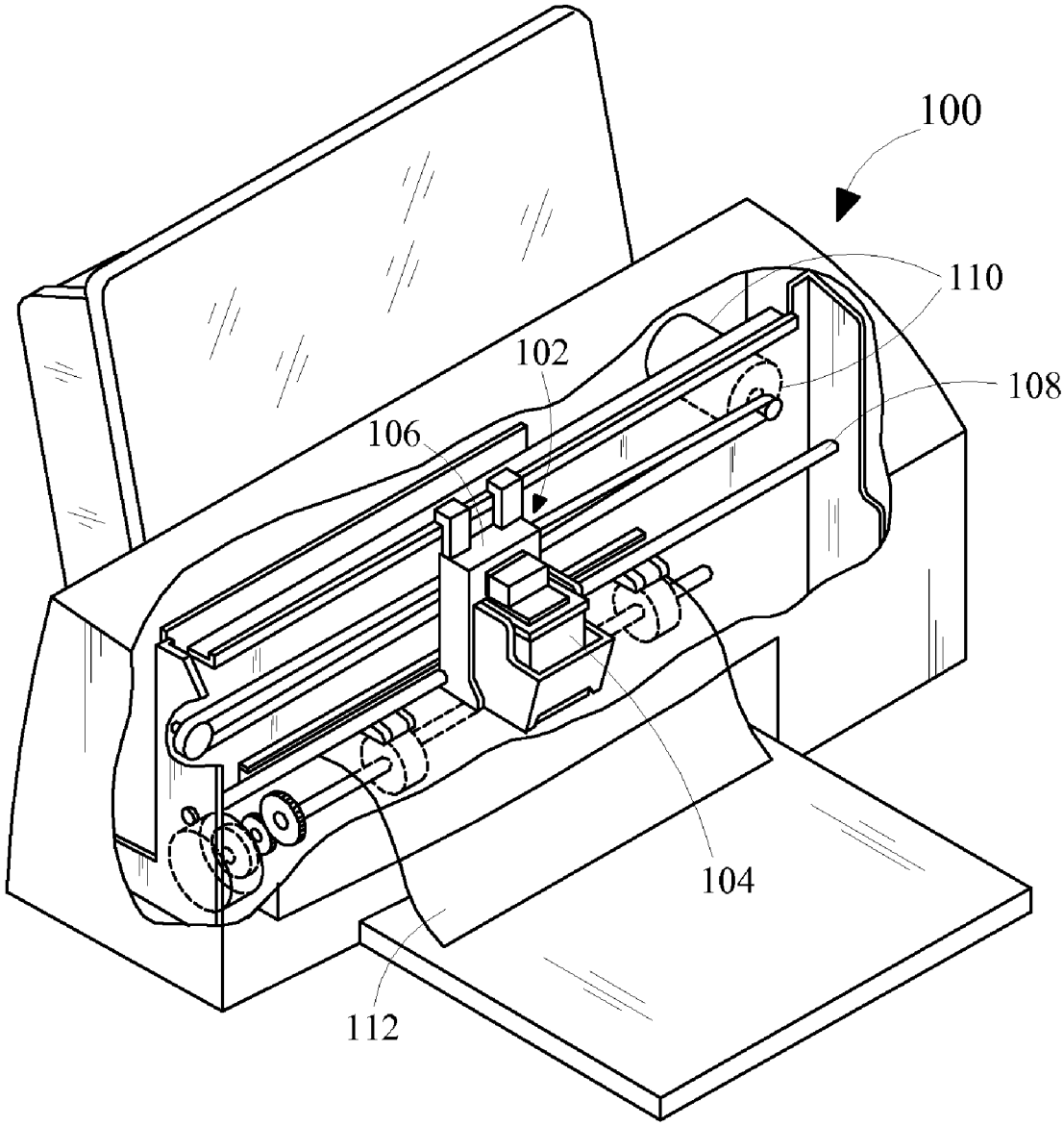
FIG. 1 is a schematic diagram of an inkjet printer, where various embodiments of the present disclosure may be embodied.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including" "comprising" or "having" and variations thereof herein is meant to encompass the items listed thereafter and equivalents thereof as well as additional items.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the present disclosure may be implemented in software. As such, it should be noted that a plurality of hardware and software-based devices, as well as a plurality of different structural components may be utilized to implement the present disclosure. Furthermore, and as described in subsequent paragraphs, the specific mechanical configurations illustrated in the drawings are intended to exemplify embodiments of the present disclosure and that other alternative mechanical configurations are possible.

The present disclosure provides a method for performing a printing of a media sheet. The method described in the present disclosure provides printing a particular area of the media sheet by a first portion of a printhead by traversing the printhead in a first direction. Further, the particular area of the media sheet is reprinted by a second portion of the printhead by traversing the printhead in a second direction opposite to the first direction. More specifically, the same area of the media sheet is printed twice by two different portions of the printhead, thereby reducing the impact of missing nozzles on the printing of any area of the media sheet.

An exemplary schematic diagram of an inkjet printer 100 is shown in FIG. 1, where various embodiments of the present disclosure may be utilized. Inkjet printer 100 includes a printing mechanism 102. Printing mechanism 102 shown in FIG. 1 is for exemplary purposes only. In general, without limiting the scope of the present invention, printing mechanism 102 will include a cartridge 104 and a printhead (not shown) coupled to a bottom surface of the cartridge 104. Cartridge 104 may be placed in carriage 106, which may be supported on a guide rail 108. Cartridge 104 may be slidably moved along guide rail 108 by using a drive mechanism 110. More specifically, the drive mechanism 110 is based on mechanical systems to move the cartridge 104 over a media sheet 112. More specifically, the printhead of the cartridge 104 moves over the media sheet 112 in a direction along the guide rail 108 in a back and forth manner. Accordingly, the media sheet 112 may be printed by the printhead in a bi-directional manner.

Printer 100 may also include a mechanism for moving media sheet 112 through a print zone defined by cartridge 104 and its movement along guide rail 108. The path media sheet 112 traverses is substantially orthogonal to the movement of cartridge 104 along guide rail 108.

The present invention provides a method for performing printing of a media sheet, such as the media sheet 112, in an inkjet printer, such as the inkjet printer 100. Without limiting the scope of the present disclosure, such method is described in conjunction with FIGS. 2 and 3.

Figure 2:
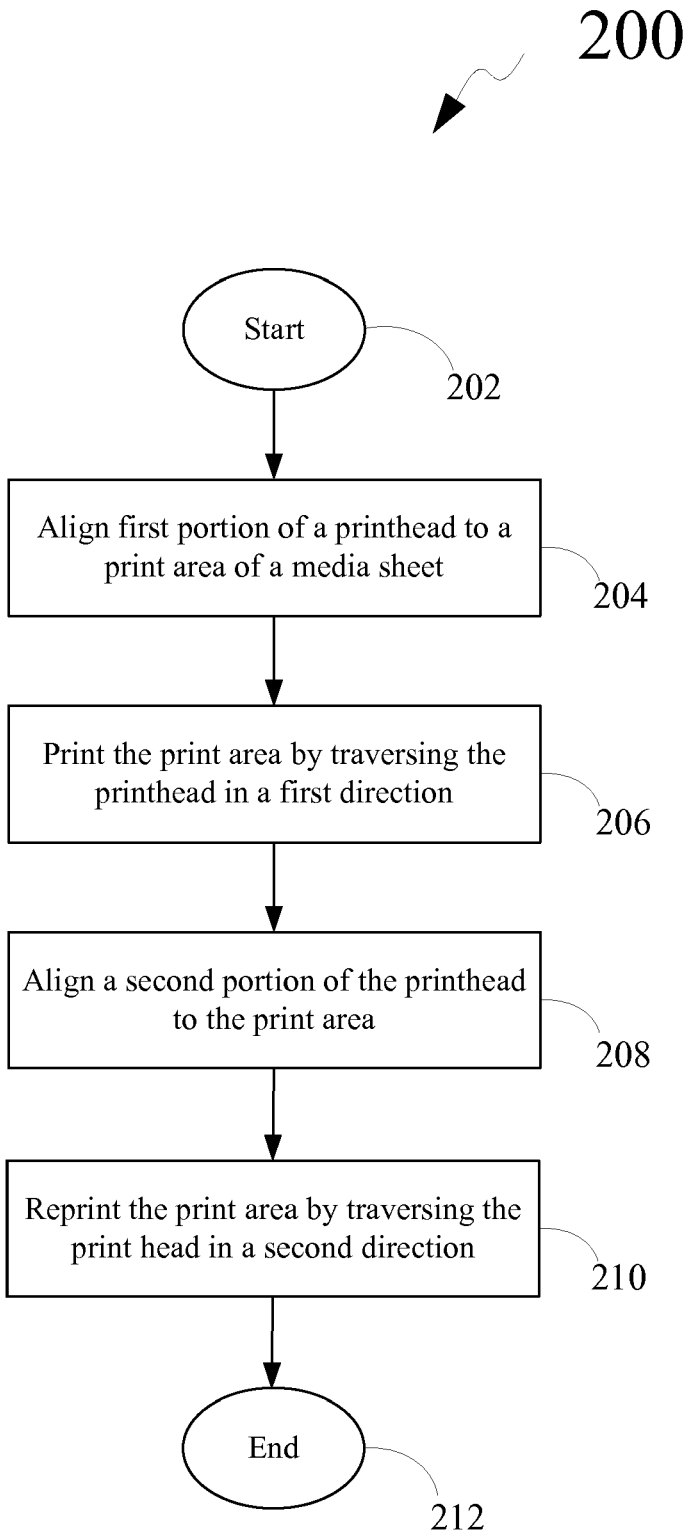
FIG. 2 is a flow diagram depicting a method for printing a media sheet in a media processing device, in accordance with an exemplary embodiment of the present disclosure.
Figure 3A:
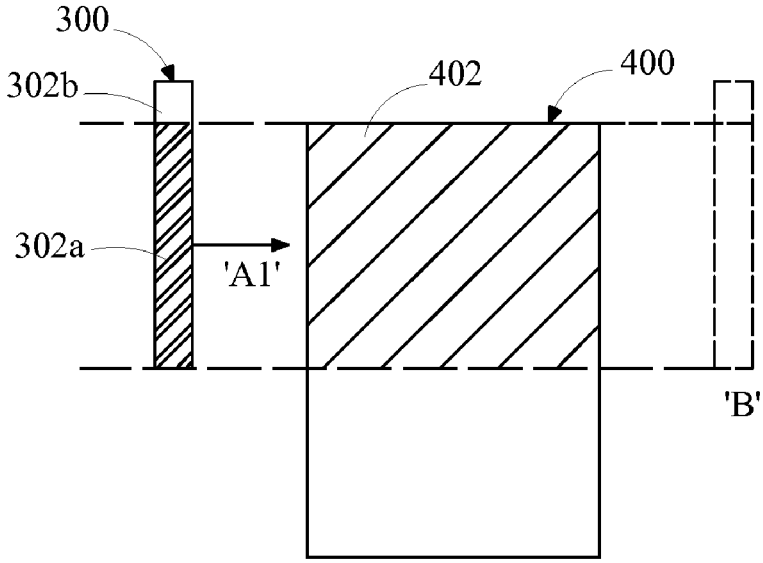
FIGS. 3A and 3B are schematic depictions of movement of a printhead during the printing of the media sheet in the media processing device by utilizing the method of FIG. 2, in accordance with an exemplary embodiment of the present disclosure.
Figure 3B:
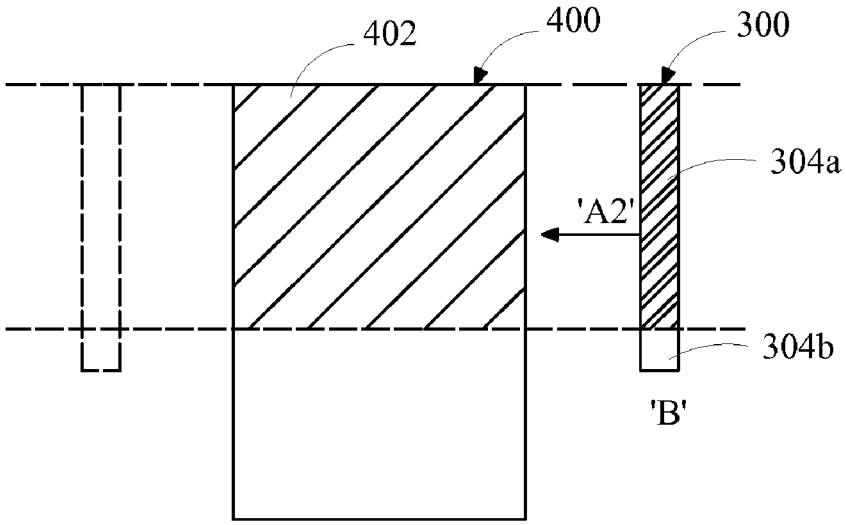

Referring now to FIG. 2, a flow diagram of a method 200 for printing a media sheet in an image processing device is shown, in accordance with an exemplary embodiment of the present disclosure. The printing is performed by traversing a printhead of the media processing device over a print area of the media sheet. In order to explain method 200, reference will be made to FIGS. 3A and 3B that depict movement of the printhead. FIGS. 3A and 3B are schematic depictions of movement of the printhead during the printing of the media sheet by utilizing method 200. Specifically, FIGS. 3A and 3B illustrate a view of a printhead 300 capable of traversing across a media sheet 400 during printing thereof, in accordance with an exemplary embodiment of the present disclosure. Printhead 300 includes a plurality of nozzles thereon. Without any limitation to the scope of the present disclosure, printhead 300 may be similar to the printhead coupled to the bottom surface of the cartridge 104, and media sheet 400 may be similar to media sheet 112, as described in conjunction with FIG. 1.

Referring to FIG. 2, method 200 commences at 202 such that media sheet 400 is aligned with respect to printhead 300 for enabling printing thereon. At 204, a first portion of printhead 300 is aligned to a print area 402 of media sheet 400.

FIG. 3A depicts the first portion of printhead 300. In the present embodiment, the first portion of printhead 300 is represented by a reference numeral 302*a* (hereinafter referred to as 'first portion 302*a*'). As shown in FIG. 3A, first portion 302*a* of printhead 300 is aligned to print area 402. Without limiting the scope of the present disclosure, in the present embodiment, first portion 302*a* may be the bottom seven-eighths portion of printhead 300. The remaining top one-eighth portion of printhead 300 is represented by reference numeral 302*b* in FIG. 3A. More specifically, the bottom seven-eighths portion of printhead 300 is aligned to print area 402 such that nozzles included in the bottom seven-eighths portion of printhead 300 are aligned to print area 402. However, in other embodiments of the present disclosure, the first portion, such as first portion 302*a*, of printhead 300 may include any proportion or number of nozzles of printhead 300.

Further, at 206, method 200 performs printing of print area 402 by traversing printhead 300 in a first direction. The first direction of traversing of printhead 300 is represented by an arrow "A1" in FIG. 3A. The printing of print area 402 by traversing printhead 300 in the first direction may be referred as a "first pass" of printing of media sheet 400. It will be apparent to those skilled in the art that in the embodiment shown in FIG. 3A, the first pass of printing is performed only by the nozzles in the seven-eighths portion of printhead 300. Specifically, the first pass of printing of print area 402 is performed by using first portion 302*a* such that nozzles of first portion 302*a* only are fired to direct ink onto print area 402 of media sheet 400. Upon completing the first pass, printhead 300 is positioned at a location 'B' adjacent to an end portion of media sheet 400, as shown in FIG. 3A. When the first pass of printing of print area 402 is complete, method 200 proceeds to 208.

At 208, media sheet 400 is adjusted relative to printhead 300 by an index distance in a direction perpendicular to the first direction. In the present embodiment, the index distance is one-eighth portion of printhead 300. It will be evident to a person skilled in the art that the index distance is bounded by the size of the portion 302*b* of printhead 300, and the index distance may be adjusted based on nozzle condition information. Specifically, the nozzle condition information provides knowledge of number of nozzles missing from the plurality of nozzles of the printhead, such as printhead 300. The nozzle condition information may be determined by utilizing any conventional method. For example, in one conventional method, optical and capacitive sensors may be utilized for identifying missing ink drops on a print area of a media sheet being printed by a printhead, thereby identifying missing nozzles of the printhead. In yet another conventional method, various patterns may be printed by a printhead on a media sheet and thereafter, the patterns may be scanned by auto-alignment sensors to determine missing ink drops of each colorant, thereby identifying the missing nozzles of the printhead.

Further, upon adjustment of the media sheet 400 relative to printhead 300 by the index distance, a second portion 304*a* of printhead 300 is aligned with print area 402. Second portion 304*a* is a top seven-eighths portion of printhead 300, as shown in FIG. 3B. A bottom one-eighth portion of printhead 300 is represented by numeral 304*b* in FIG. 3A. Accordingly, in the present embodiment, printhead 300 positioned at location 'B' is adjusted perpendicular to the first direction by an index distance equal to one-eighth portion of printhead 300 such that second portion 304*a* is aligned to print area 402.

Thereafter, second portion 304*a* of printhead 300 is traversed over print area 402 in a second direction for reprinting print area 402, at 210. As shown in FIG. 3B, the second direction (represented by arrow "A2") is opposite to the first direction (shown in FIG. 3A). Further, the traversal of second portion 304*a* over print area 402 in the second direction is referred to as a "second pass" of printhead 300. During the second pass, nozzles in second portion 304*a* are fired to direct ink over print area 402, thereby reprinting print area 402. Specifically, the same print area, i.e. print area 402, is printed by different portions, such as first portion 302*a* and second portion 304*a*, of printhead 300. More specifically, two different sets of nozzles, such as one from first portion 302*a* and the other from second portion 304*a*, direct ink on each row of print area 402 of media sheet 400 during each of the first pass and the second pass. Accordingly, each row in print area 402 of media sheet 400 is printed twice by the two different sets of nozzles. Consequently, printing defects associated with missing nozzles on printhead 300 are significantly reduced. Upon reprinting print area 402, method 200 concludes at 212.

Depending upon the nozzle condition information for obtaining knowledge of the missing nozzles of a printhead, such as printhead 300, media sheet 400 may be adjusted relative to printhead 300 by a particular index distance for reducing the printing defects associated with missing nozzles. For a description of utilization of method 200 for reducing printing defects, consider an example in which the printhead has a small number of missing nozzles such that the number of missing nozzles is less than a threshold number of nozzles required for efficient printing. In such a case, the present disclosure prints a media sheet without adjusting the media sheet relative to the printhead by a particular index distance, i.e., the index distance may be set as equal to zero. Specifically, normal printing operation is carried out without causing any index distance shift to the media sheet relative to the printhead.

In another example, nozzles at a particular location, such as end nozzles, on the printhead are missing. In such a case, the present disclosure precludes the usage of such end nozzles during the first pass and the second pass. In one embodiment, such end nozzles may be removed from the printhead so that usage of such end nozzles may be avoided. Further, the media sheet may not be shifted by any particular index distance relative to the printhead, i.e., the index distance may be equal to zero. Alternatively, the media sheet may be shifted by an appropriate index distance relative to the printhead such that the missing end nozzles are not used in either of the first pass and the second pass. For example, if $2^{nd}$ and $5^{th}$ nozzles out of 640 nozzles of a printhead are missing, the present example contemplates usage of $6^{th}$ to $640^{th}$ nozzles only.

In yet another example, if a particular number of nozzles, apart from end nozzles, are missing from the printhead, a small index distance adjustment may be applied to the media sheet relative to the printhead, such as previously described.

For description of utilization of the present disclosure to reduce printing defects, another case may be considered where a particular number of nozzles of plurality of nozzles of the printhead are missing in a manner such that the missing nozzles map to same row on a media sheet. In such a case, missing ink drops may spread as much as possible on the media sheet. For example, if two nozzles in the printhead are missing in a manner such that the two nozzles are exactly apart by the index distance, the two nozzles would always map onto the same row on the media sheet. Accordingly, the method 200 of the present disclosure may be utilized by regulating the usage of nozzles of the printhead and the index distance of the media sheet relative to the printhead appropriately, such that the missing nozzles do not map over each other.

The method for printing media sheet, as described herein, effectively reduces printing defects that occur due to missing nozzles of a printhead. Further, as explained herein, the method may be suitably utilized for reducing printing defects based upon knowledge of number and location of missing nozzles of the printhead. Moreover, the method may be utilized for reducing color-order defects and dry-time related defects such that in the present disclosure two nozzles of any colorant may be used to direct ink on each row on a media sheet.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A method for twice printing a same media sheet in a media processing device, the method comprising:

aligning a first portion of a printhead of the media processing device to a print area of the media sheet, the first portion having a first group of nozzles;

printing the print area of the media sheet by traversing the printhead over the print area of the media sheet in a first direction, the printing performed by the first portion of the printhead;

aligning a second portion of the printhead to the print area of the media sheet by adjusting the media sheet relative to the printhead by an index distance in a direction perpendicular to the first direction, the second portion of the printhead having a second group of nozzles different than the first group of nozzles; and reprinting again the print area of the media sheet by traversing the printhead over the print area of the media sheet in a second direction opposite to the first direction, the reprinting performed by the second portion of the printhead having the second group of nozzles different than the first group of nozzles.

2. The method of claim 1, wherein adjusting the media sheet relative to the printhead by the index distance is performed based on a nozzle condition information of the printhead.

3. The method of claim 2, wherein the nozzle condition information comprises information corresponding to a least one location of missing nozzles of the printhead.

4. The method of claim 3 further comprising removing end nozzles of the printhead from the printing and the reprinting when the location of the missing nozzles is at least one end portion of the printhead.

5. The method of claim 4 further comprising setting the index distance equal to zero.

6. The method of claim 2, wherein the nozzle condition information comprises information corresponding to a number of missing nozzles of the printhead.

7. The method of claim 6 further comprising setting the index distance equal to zero when the number of missing nozzles of the printhead is less than a threshold number of nozzles.

8. A media processing device for twice printing a same media sheet, the media processing device comprising:

a printhead having nozzles configured to print a print area of the media sheet; and a drive mechanism coupled to the printhead, the drive mechanism configured to:

align a first portion of a first group of nozzles of the printhead to the print area of the media sheet, wherein the printhead is configured to print the print area of the media sheet by traversing over the print area of the media sheet in a first direction, the printing of the print area performed by the first group of nozzles of the printhead, and align a second portion of a second group of nozzles of the printhead to print again the earlier printed said print area of the media sheet by adjusting the media sheet relative to the printhead by an index distance in a direction perpendicular to the first direction, wherein the printhead is configured to reprint the print area of the media sheet by traversing over the print area of the media sheet in a second direction opposite to the first direction, the reprinting of the print area performed by the second portion of the printhead whereby the second group of nozzles is different than the first group of nozzles.

9. The media processing device of claim 8, wherein the drive mechanism is further configured to adjust the media sheet relative to the printhead by the index distance based on a nozzle condition information of the printhead.

10. The media processing device of claim 9, wherein the nozzle condition information comprises information corresponding to location of missing nozzles of the printhead.

11. The media processing device of claim 10, wherein the end nozzles of the printhead are removed from printing of the media sheet when the location of the missing nozzles is at least one end portion of the printhead.

12. The media processing device of claim 11, wherein the index distance is equal to zero.

13. The media processing device of claim 9, wherein the nozzle condition information comprises information corresponding to number of missing nozzles of the printhead.

14. The media processing device of claim 13, wherein the index distance is equal to zero when the number of missing nozzles of the printhead is less than a threshold number of nozzles.

* * * * *